US006520391B2

(12) United States Patent
Yen

(10) Patent No.: US 6,520,391 B2
(45) Date of Patent: Feb. 18, 2003

(54) BABY SHOULDER CRADLE

(76) Inventor: Kuo-Chun Yen, 2F, No. 16, Lane 35, Hwang Shi St., Shih Lin, Taipei (TW)

( * ) Notice: Subject to any disclaimer, the term of this patent is extended or adjusted under 35 U.S.C. 154(b) by 30 days.

(21) Appl. No.: 09/924,751

(22) Filed: Aug. 7, 2001

(65) Prior Publication Data

US 2002/0158094 A1 Oct. 31, 2002

(30) Foreign Application Priority Data

Apr. 26, 2001 (TW) ..... 90206654 U

(51) Int. Cl.[7] ..... A61G 1/00
(52) U.S. Cl. ..... 224/160; 224/608; 224/637
(58) Field of Search ..... 224/158, 159, 224/160, 608, 637

(56) References Cited

U.S. PATENT DOCUMENTS 5,246,152 A * 9/1993 Dotseth ..... 224/159
D357,800 S * 5/1995 Roan et al. ..... D3/214
5,490,620 A * 2/1996 Bergqvist ..... 224/160
5,678,739 A * 10/1997 Darling et al. ..... 224/160
5,813,580 A * 9/1998 Fair ..... 224/160

* cited by examiner

*Primary Examiner*—Stephen K. Cronin
(74) *Attorney, Agent, or Firm*—Pro-Techtor International Services

(57) ABSTRACT

A baby shoulder cradle having a flexible cradle body adapted to carry the baby, a first shoulder strap and a second shoulder strap for hanging on the user's shoulders, and a waist strap adapted to secure the cradle body to the user's waist, the first shoulder strap being diagonally fastened to the back panel of the cradle body and length-adjustably equipped with an adjustment buckle, the second shoulder having one end fixedly fastened to the cradle body and the other end looped and slidably coupled to the first shoulder strap.

4 Claims, 7 Drawing Sheets

BABY SHOULDER CRADLE

BACKGROUND OF THE INVENTION

The present invention relates to a baby shoulder cradle and, more particularly, to such a baby shoulder cradle that can be hung on the user's shoulder to carry the baby in a sitting position on the front or back side of the user, or in a lying position on the front side of the user.

A variety of baby shoulder cradles have been disclosed for use to carry a baby on the shoulders, and have appeared on the market. FIG. 1 shows one prior art design of baby shoulder cradle A. This structure of baby shoulder cradle A is to be hung on one shoulder to carry the baby in a lying position on the front side of the user. This structure of baby shoulder cradle A is not suitable for carrying the baby on the user's back side. Further, this structure of baby shoulder cradle A cannot be hung on the user's shoulders to carry the baby in a sitting position. FIG. 2 shows another prior design of baby shoulder cradle B. This design of baby shoulder cradle B is to be hung on the user's shoulders to carry the baby on the user's front side in a sitting position. This design of baby shoulder cradle B cannot carry the baby in a lying position.

SUMMARY OF THE INVENTION

The present invention has been accomplished to provide a baby shoulder cradle, which eliminates the aforesaid drawbacks. It is one object of the present invention to provide a baby shoulder cradle, which can be hung on the user's shoulders to carry the baby on the user's front side or back side. It is another object of the present invention to provide a baby shoulder cradle, which can be hung on the user's shoulders to carry the baby on the user's front side in a sitting position or lying position. It is still another object of the present invention to provide a baby shoulder cradle, which can be adjusted to fit the body size of the baby comfortably. It is still another object of the present invention to provide a baby shoulder cradle, which has means to protect the baby's legs. According to one aspect of the present invention, the baby shoulder cradle comprises a flexible cradle body adapted to carry the baby, a first shoulder strap and a second shoulder strap for hanging on the user's shoulders, and a waist strap adapted to secure the cradle body to the user's waist. The first shoulder strap is diagonally fastened to the back panel of the cradle body, having an adjustment buckle adapted to adjust the length of the first shoulder strap. The second shoulder has one end fixedly fastened to the cradle body, and the other end looped and slidably coupled to the first shoulder strap. According to another aspect of the present invention, an adjustment girdle belt is provided and adapted to adjust the holding space of the cradle body subject to the body size of the baby to be carried. According to still another aspect of the present invention, re-openable leg bags are provided at the cradle body, and adapted to receive the legs of the baby carried in the cradle body. According to still another aspect of the present invention, the cradle body is reinforced with a PE (polyethylene) board lining against deformation.

DETAILED DESCRIPTION OF THE PREFERRED EMBODIMENT

Figure 1:
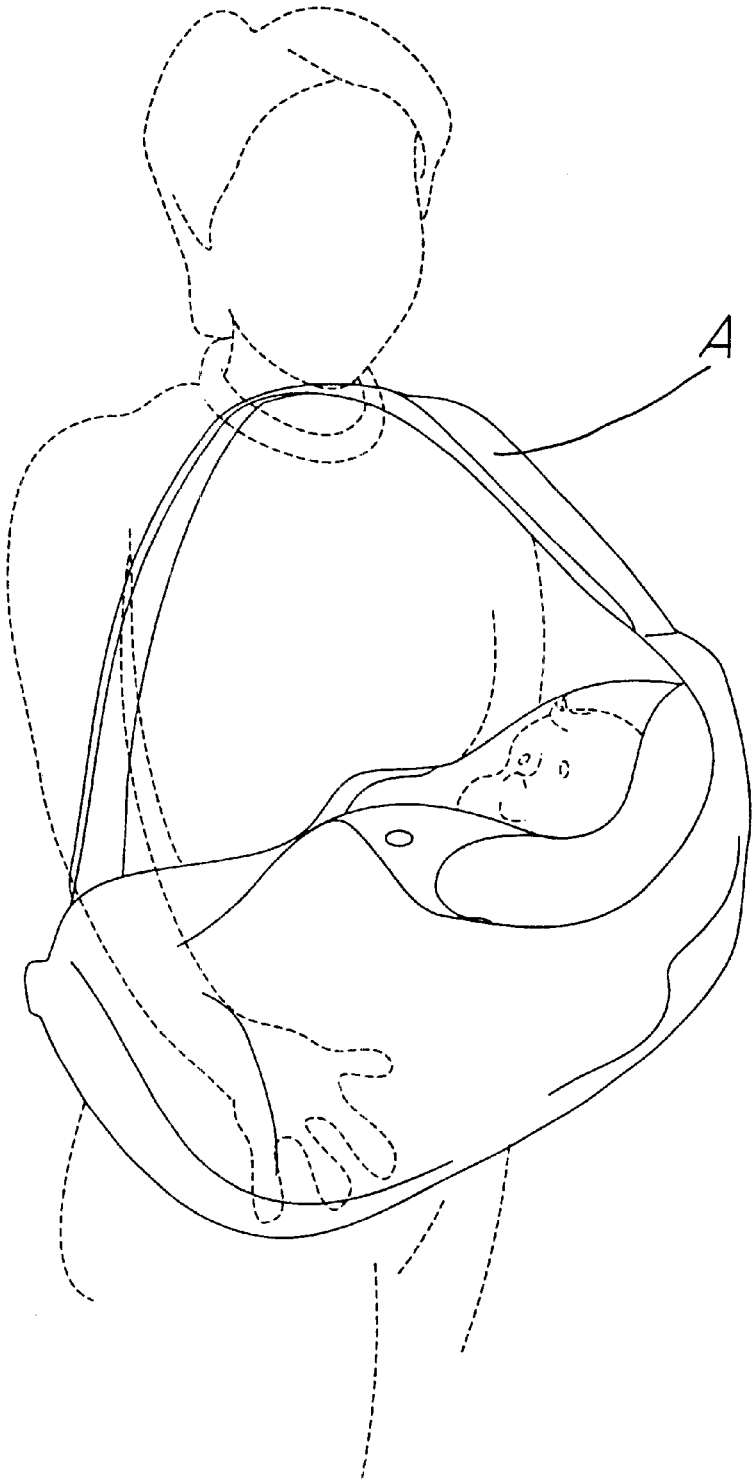
FIG.1 PRIOR ART
FIG. 1 shows an application example of a prior art baby shoulder cradle.
Figure 2:
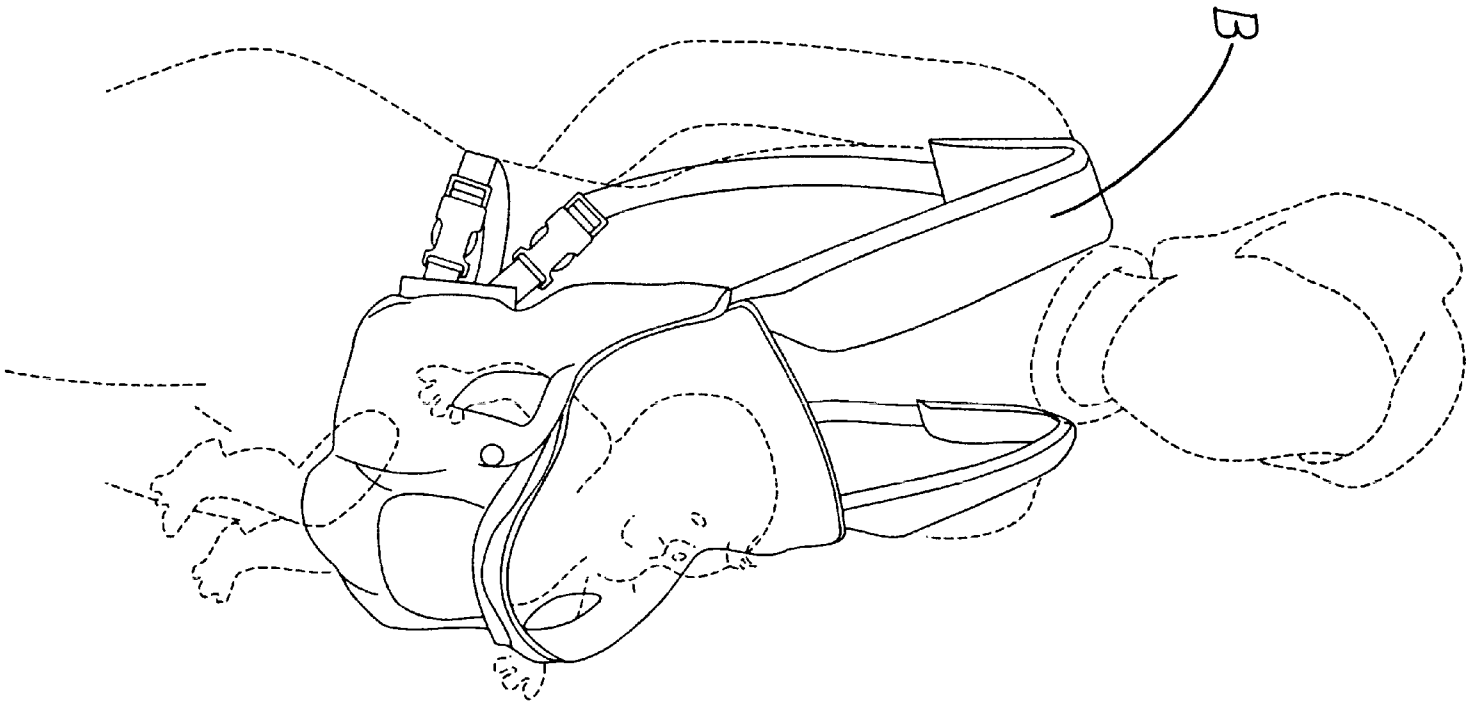
FIG.2 PRIOR ART
FIG. 2 shows an application example of another prior art design of baby shoulder cradle.
Figure 3:
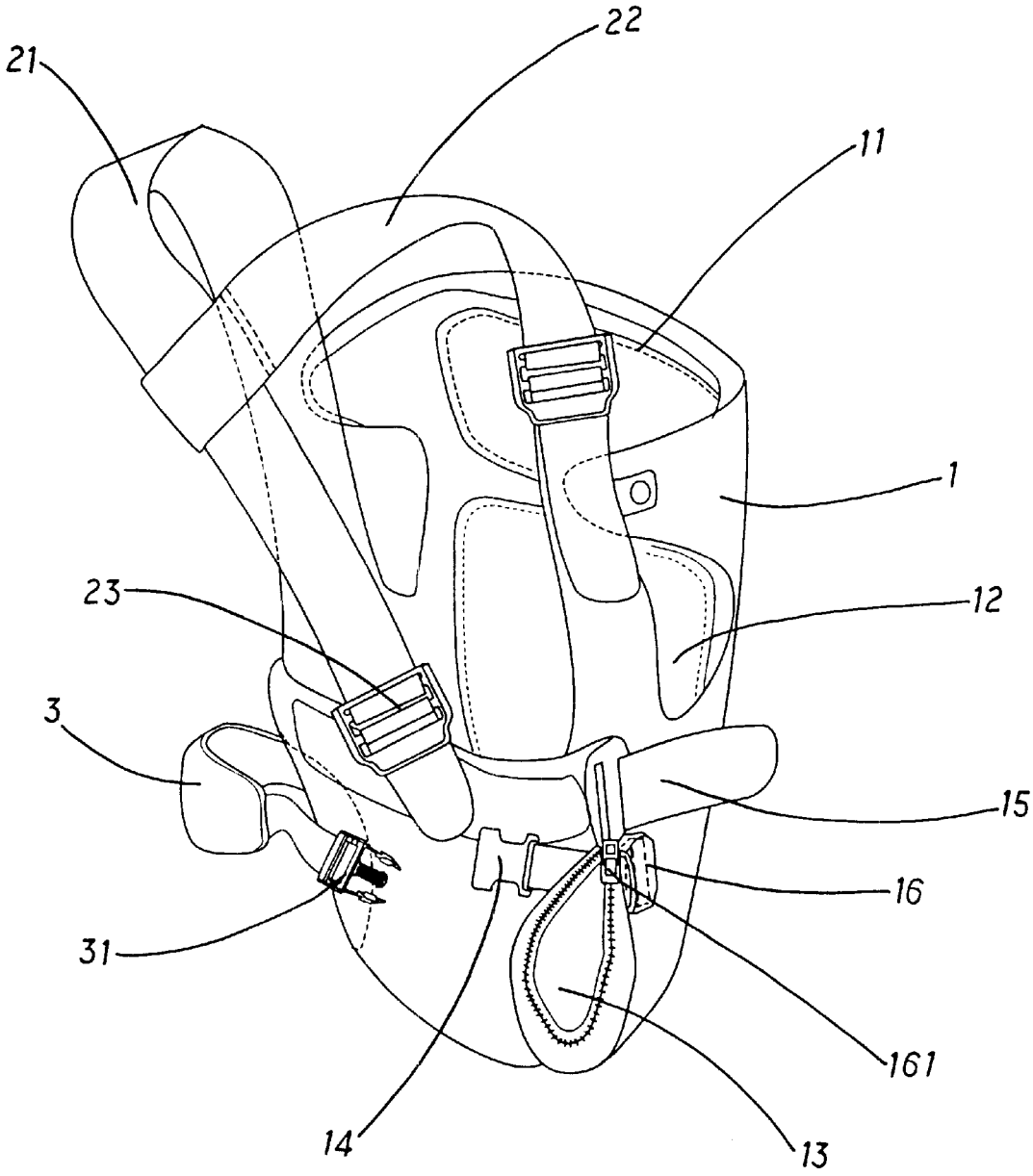
FIG. 3 is a perspective view of a baby shoulder cradle constructed according to the present invention.
Figure 4:
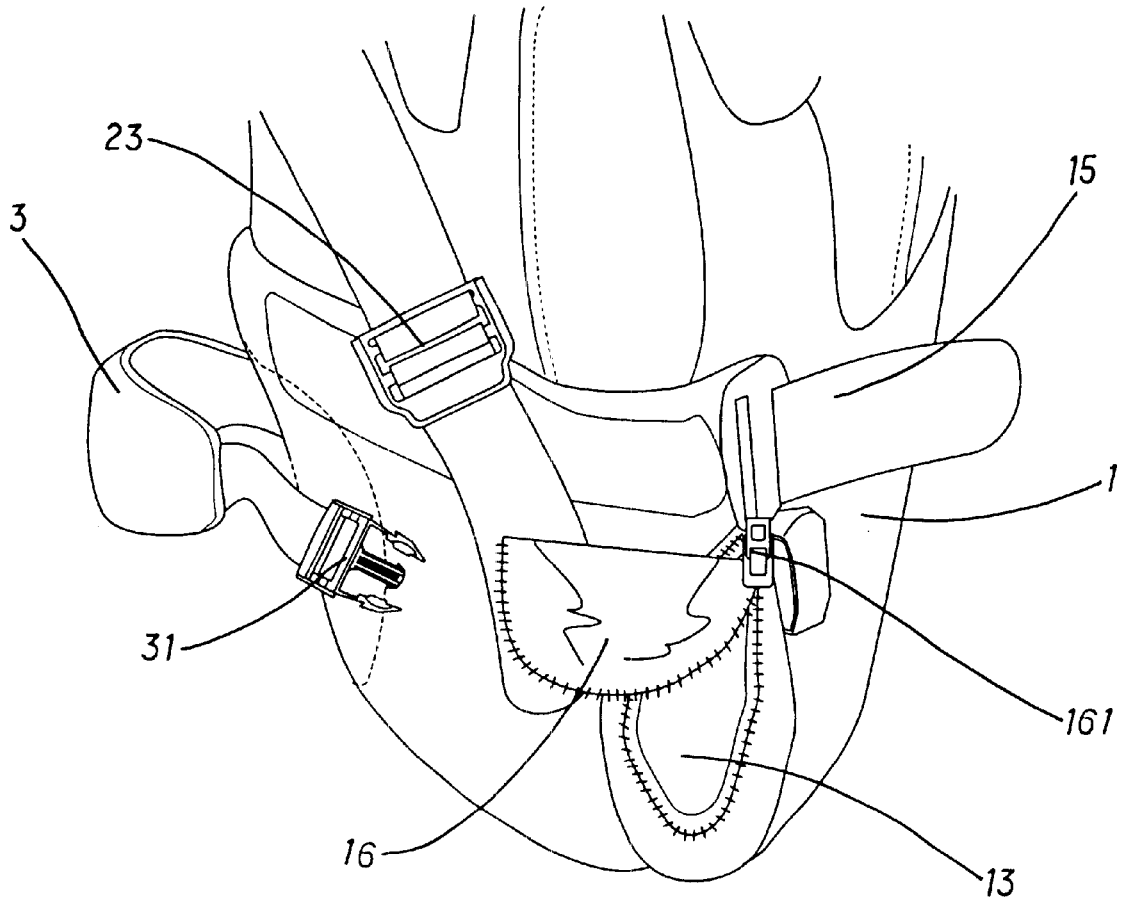
FIG. 4 is an enlarged view of the lower part of the present invention, showing the protect leg bag opened.

Referring to FIGS. 3 and 4, a baby shoulder cradle in accordance with the present invention is generally comprised of a flexible cradle body 1, two shoulder straps 21;22, and a waist strap 3. The flexible cradle body 1 is reinforced with a PE (polyethylene) board lining 11, having hand holes 12 and leg holes 13 symmetrically disposed at different elevations through which the baby's limbs extend to the outside of the cradle body 1. The PE board lining 11 supports the cradle body 1 in shape.

The first shoulder strap 21 is diagonally provided at the back panel of the cradle body 1, having an adjustment buckle 23 adapted to adjust the length of the first shoulder strap 21. The second shoulder strap 22 has one end connected to the back panel of the cradle body 1 near the top remote from the first shoulder strap 21, and the other end looped and slidably coupled to the first shoulder strap 21. The waist strap 3 has one end fixedly fastened to one lateral side of the cradle body 1 near the bottom, and the other end terminating in a quick-release plug 31. A quick-release socket 14 is provided at the other lateral side of the cradle body 1, and adapted to receive the quick-release plug 31.

Figure 5:
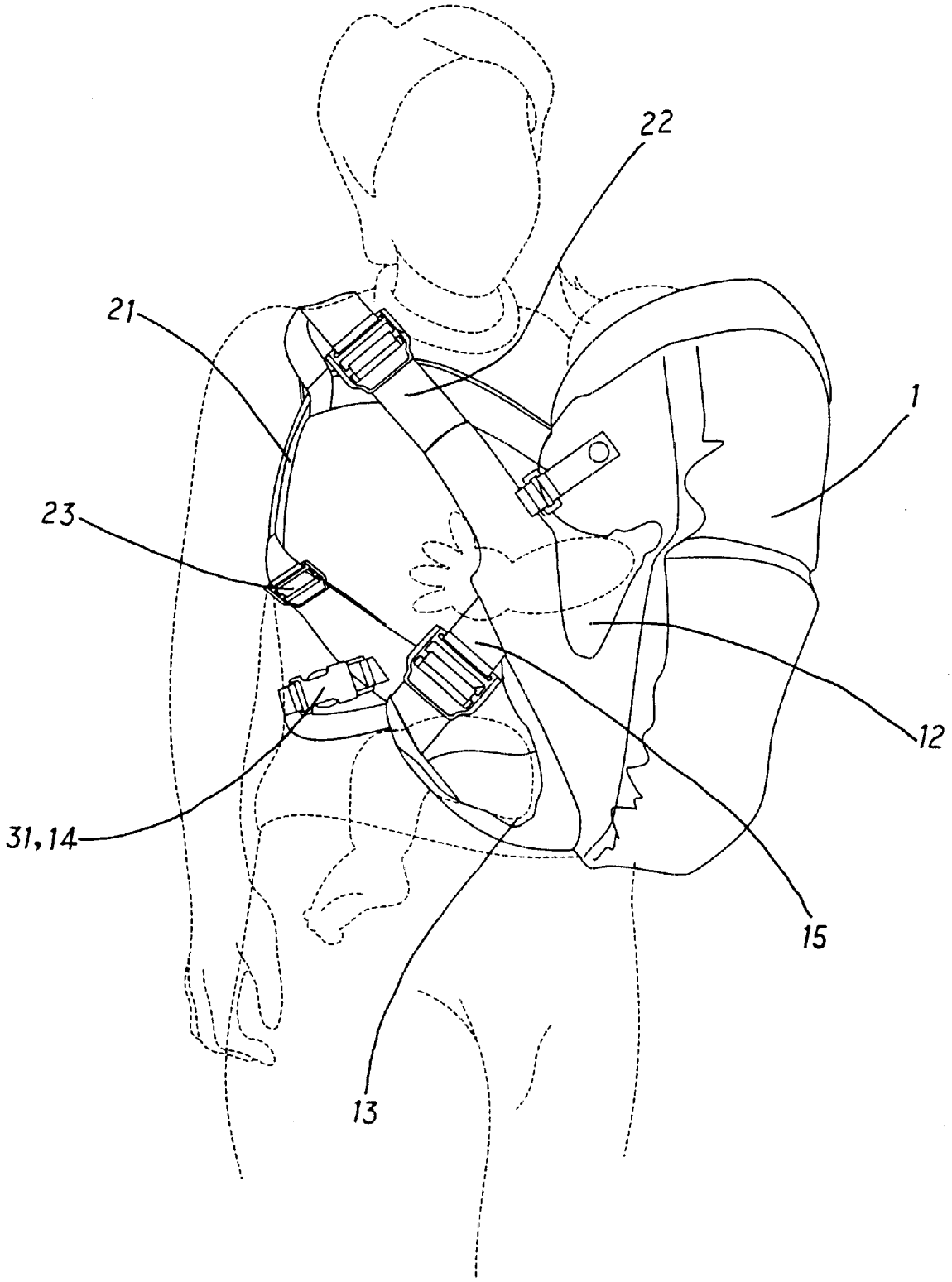
FIG. 5 shows one application example of the present invention.
Figure 6:
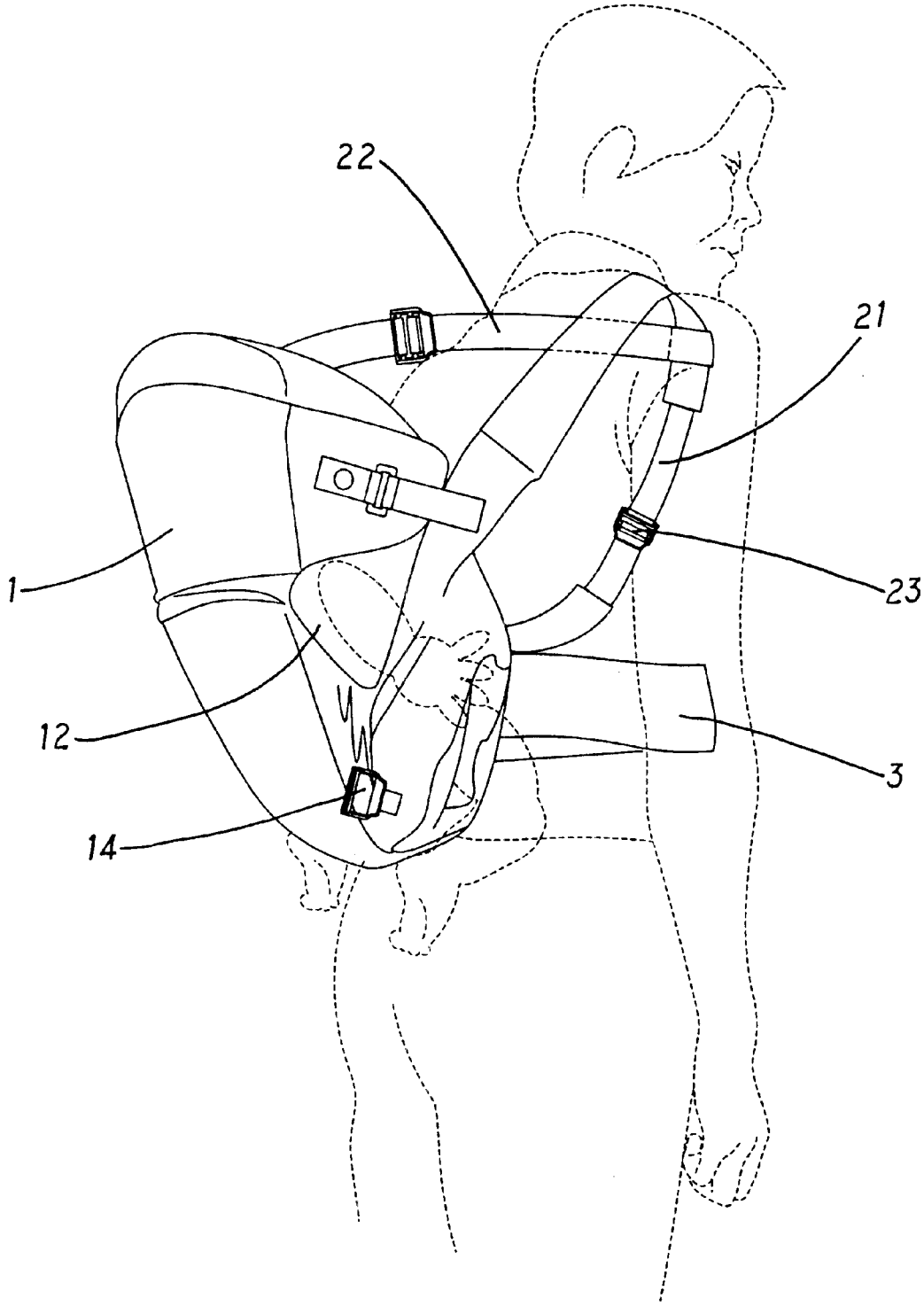
FIG. 6 shows another application example of the present invention.
Figure 7:
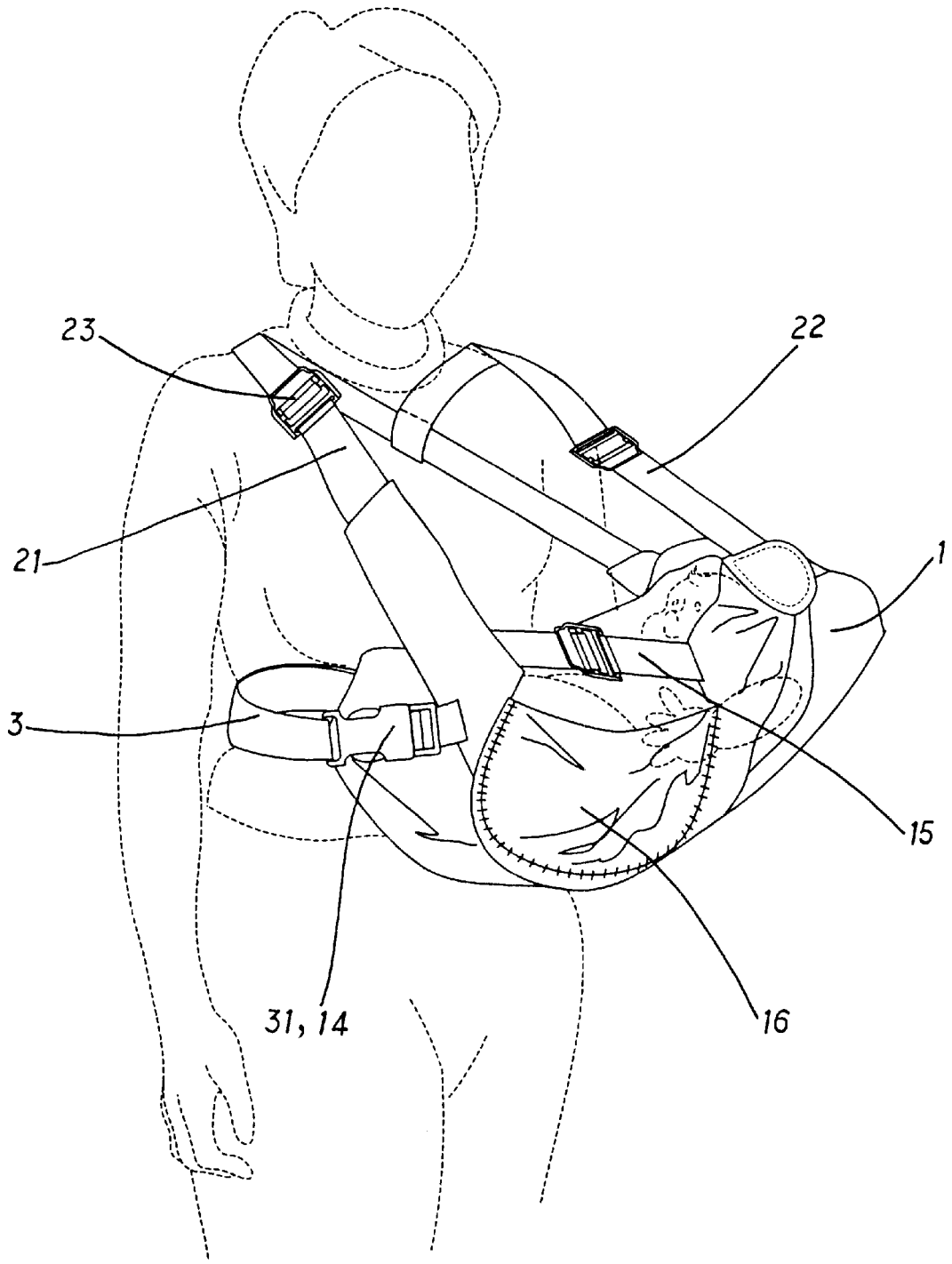
FIG. 7 shows still another application example of the present invention.

When in use, the first shoulder strap 21 and the second shoulder strap 22 are hung on the user's shoulders to hold the cradle body 1 in the user's front side (see FIG. 5) or back side (see FIG. 6), and then the quick-release plug 31 of the waist strap 3 is extended over the user's back side (see FIG. 5) or front side (see FIG. 6) and fastened to the quick-release socket 14, and then the first shoulder strap 21 is adjusted to the desired length by means of adjusting the adjustment buckle 23, and then the looped end of the second shoulder strap 22 is moved along the first shoulder strap 21 to the best-fit position, keeping the baby comfortably sitting in the cradle body 1. Further, by means of extending the length of the first shoulder strap 21, the baby shoulder cradle can be hung on the user's shoulder to carry the baby lying on the cradle body 1 (see FIG. 7)

Referring to FIGS. 3 and 4 again, an adjustment girdle 15 is provided at the cradle body 1, and adapted to adjust the holding space of the cradle body 1 subject to the body size of the baby to be carried. Two protective leg bags 16 are fastened to the periphery of each of the leg holes 13 of the cradle body 1, and adapted to receive the baby's legs. The protective leg bags 16 each have an opening (not shown) re-openably closed by fastener means, for example, a zip fastener 161.

A prototype of baby shoulder cradle has been constructed with the features of FIGS. 4~7. The baby shoulder cradle functions smoothly to provide all of the features discussed earlier.

Although a particular embodiment of the invention has been described in detail for purposes of illustration, various modifications and enhancements may be made without departing from the spirit and scope of the invention. Accordingly, the invention is not to be limited except as by the appended claims.

What the invention claimed is:

1. A baby shoulder cradle comprising a flexible cradle body adapted to carry a baby, said cradle body having two hand holes and two leg holes disposed at different elevations through which the limbs of the baby being carried in said cradle body extend to the outside of said cradle body, a first shoulder strap and a second shoulder strap respectively fastened to said cradle body and adapted to hang said cradle body on the user's shoulders, and a waist strap adapted to secure said cradle body to the user's trunk, wherein said first shoulder strap is diagonally provided at a back panel of said cradle body, having an adjustment buckle adapted to adjust the length of said first shoulder strap; said second shoulder strap has one end connected to said cradle body, and an opposite end looped and slidably coupled to said first shoulder strap; said waist strap has one end fixedly fastened to one lateral side of said cradle body and an opposite end terminating in a quick-release plug for connection to a quick-release socket provided at one lateral side of said cradle body remote from the connection area between said waist strap and said cradle body.

2. The baby shoulder cradle of claim 1 wherein said cradle body comprises an adjustment girdle belt adapted to adjust the holding space of said cradle body subject to the body size of the baby to be carried.

3. The baby shoulder cradle of claim 1 wherein said cradle body comprises two leg bags respectively fastened to said leg holes and adapted to receive the legs of the baby being carried in said cradle body, said leg bags each having an opening and fastener means adapted to close/open said opening.

4. The baby shoulder cradle of claim 1 wherein said cradle body is reinforced with a polyethylene board lining.

* * * * *